US005090388A

United States Patent [19]

Hamburg et al.

[11] Patent Number: 5,090,388

[45] Date of Patent: Feb. 25, 1992

[54] AIR/FUEL RATIO CONTROL WITH ADAPTIVE LEARNING OF PURGED FUEL VAPORS

[75] Inventors: Douglas R. Hamburg, Birmingham; Martin F. Davenport, Plymouth, both of Mich.

[73] Assignee: Ford Motor Company, Dearborn, Mich.

[21] Appl. No.: 620,952

[22] Filed: Dec. 3, 1990

[51] Int. Cl.[5] ..... F02D 41/14; F02M 25/08

[52] U.S. Cl. ..... 123/489; 123/520

[58] Field of Search ..... 123/489, 520, 519, 518, 123/521

[56] References Cited

U.S. PATENT DOCUMENTS 4,467,769 8/1984 Matsumura ..... 123/489
4,641,623 2/1987 Hamburg ..... 123/518
4,715,340 12/1987 Cook et al. ..... 123/406
4,741,318 5/1988 Kortge et al. ..... 123/520
4,748,959 6/1988 Cook et al. ..... 123/520
4,967,713 11/1990 Kojima ..... 123/489

*Primary Examiner*—Andrew M. Dolinar
*Attorney, Agent, or Firm*—Allan J. Lippa; Peter Abolins

[57] ABSTRACT

A system and method for controlling operation of an engine wherein a fuel vapor recovery system is coupled between an air/fuel intake and a fuel supply system. An air/fuel ratio indication is provided by a proportional plus integral feedback controller coupled to a two-state exhaust gas oxygen sensor. In response to the air/fuel ratio indication and a measurement of inducted air flow, a base fuel command is generated. To compensate for purging of fuel vapors, a reference air/fuel ratio is subtracted from the air/fuel ratio indication and the resulting error signal generated. This compensation factor represents a learned value which is directly related to fuel vapor concentration, and it is subtracted from the base fuel command to correct for induction of fuel vapors.

13 Claims, 4 Drawing Sheets

PURGE RATE CONTROLLER
BASE FUEL CONTROLLER
LAMBSE CONTROLLER
MULTIPLIER
INTEGRATOR
LAM_R
LAM_e
PCOMP
PPW
Fdm
Fd
CA
MAP
MAF
T
Pf_d
rpm
MAP
BP
Pf_c
EGO
PCOMP
MAF
A/F_D

AIR/FUEL RATIO CONTROL WITH ADAPTIVE LEARNING OF PURGED FUEL VAPORS

BACKGROUND OF THE INVENTION

The field of the invention relates to air/fuel ratio control for motor vehicles having a fuel vapor recovery system coupled between the fuel supply system and the air/fuel intake of an internal combustion engine.

Modern engines are equipped with 3-way catalytic converters ($NO_X$, CO, and HC) to minimize emissions. Efficient operation requires that the engine's air/fuel ratio be maintained within an operating window of the catalytic converter. For a typical converter, the desired air/fuel ratio is referred to as stoichiometry which is typically 14.7 lbs. air/lb. fuel. During steady-state engine operation, the desired air/fuel ratio is approached by an air/fuel ratio feedback control system responsive to an exhaust gas oxygen sensor. More specifically, a fuel charge is first determined for open loop operation by dividing a measurement of inducted airflow by the desired air/fuel ratio (such as 14.7). This open loop charge is then trimmed by a feedback correction factor responsive to an exhaust gas oxygen sensor. Electronically actuated fuel injectors are actuated in response to the trimmed fuel charge determination. In this manner, steady-state engine operation is maintained near the desired air/fuel ratio.

Air/fuel ratio control has been complicated, and in some cases made unachievable, by the addition of fuel vapor recovery systems. These systems store excess fuel vapors emitted from the fuel tank in a canister having activated charcoal or other hydrocarbon absorbing material to reduce emission of such vapors into the atmosphere. To replenish the canisters storage capacity, air is periodically purged through the canister, absorbing stored hydrocarbons, and the mixture of vapors and purged air inducted into the engine. Concurrently, vapors are inducted directly from the fuel tank into the engine.

Induction of rich fuel vapors creates at least two types of problems for air/fuel ratio control systems. Since there is a time delay for an air/fuel charge to propagate through the engine to the exhaust sensor, any perturbation in inducted airflow, such as caused by the sudden change in throttle position, will result in an air/fuel transient until the feedback loop responsive to the exhaust gas oxygen sensor is able to correct for such perturbation. Further, conventional air/fuel ratio feedback control systems have a limited range of authority. Induction of rich fuel vapors may exceed the feedback system's range of authority resulting in an unacceptable increase in emissions.

U.S. Pat. No. 4,715,340 has addressed some of the above problems. More specifically, a combined air/fuel ratio feedback control system and vapor purge system is disclosed. To reduce the air/fuel transient which may occur during rapid throttle changes, the purged rate of vapor flow is made proportional to the rate of inducted airflow. Allegedly, any change in inducted airflow will then be accompanied by a corresponding change in purged vapor flow such that the overall air/fuel ratio is not significantly perturbed during a change in throttle angle.

The inventors herein have recognized numerous disadvantages with the prior approaches. For example, modern aerodynamic styling has resulted in less air cooling flow around the fuel system and, accordingly, an increase in fuel vapor generation. In addition, government regulations are restricting the amount of vapors which may be discharged into the atmosphere. This trend will continue on an ever more strident basis in the future. Accordingly fuel vapor recovery systems in which purge flow is proportional to airflow may no longer be satisfactory because the rate of purge flow may be less than required to adequately reduce fuel vapors at conditions other than full throttle. The inventors herein have therefore sought to provide a system which inducts fuel vapors at a maximum rate over all engine operating conditions including idle. A need exists for such a system which does not exceed the air/fuel feedback system's range of authority and which does not introduce air/fuel transients during sudden throttle changes.

SUMMARY OF THE INVENTION

An object of the invention is to provide a fuel vapor recovery system in which the rate of purged fuel vapor flow is at a substantially constant maximum rate over a wide range of engine operation conditions. An additional object is to provide a feedback control system which adaptively learns the concentration of fuel vapors in the purged vapor mixture and adjusts the inducted air/fuel mixture accordingly.

The above objects are achieved, and disadvantages of prior approaches overcome, by providing both a control system and method for controlling air/fuel operation of an engine wherein a fuel vapor recovery system is coupled between an air/fuel intake and a fuel supply system. In one particular aspect of the invention, the method comprises the steps of: providing an air/fuel ratio indication of the engine operation in response to an exhaust gas oxygen sensor; generating a base fuel command in response to the air/fuel ratio indication; purging a vapor mixture of fuel vapor and air from the fuel vapor recovery system into the engine air/fuel intake through an electronically controllable valve; controlling the valve to purge the purged vapor mixture at a substantially constant rate over a range of engine operating conditions; measuring fuel vapor content in the purged vapor mixture by subtracting a reference air/fuel ratio, related to engine operation without purging, from the air/fuel ratio indication to generate an air/fuel ratio error; and subtracting the fuel vapor content measurement from the base fuel command to operate the engine at a desired air/fuel ratio during fuel vapor purging.

An advantage of the above aspect of the invention is that engine air/fuel ratio control is maintained without significant transients while fuel vapors are purged despite variations in induced airflow. Another advantage is that the purged vapor mixture is maintained at a substantially constant flow rate over a range of engine operating conditions such as variations in inducted airflow. Accordingly, maximum purge of vapors is achieved even at idle conditions. Another advantage of the above aspect of the invention is that the actual fuel vapor content of the purged vapor mixture is learned or measured. Accordingly, highly accurate air/fuel ratio control is obtainable when purging fuel vapors.

In another aspect of the invention, the control system comprises: feedback control means responsive to an exhaust gas oxygen sensor for providing an air/fuel ratio indication; command means for providing a base fuel command in response to the air/fuel ratio indication; purging means responsive to engine operating parameters for purging fuel vapors from the fuel vapor recovery system into the intake manifold at a substantially constant flow rate by controlling a valve positioned between the fuel vapor recovery system and the intake manifold, the purging means including regulation means for further controlling the valve in relation to pressure at the intake manifold to maintain the constant flow rate; vapor indicating means for providing an indication of vapor content in the purged fuel vapor by subtracting a reference air/fuel ratio, related to engine operation without purging, from the air/fuel ratio indication to generate an air/fuel ratio error and integrating the air/fuel ratio error indication; and compensation means for subtracting a purged vapor compensation factor related to the vapor content indication from the base fuel command for operating the engine at a desired air/fuel ratio during fuel vapor purging.

An advantage of the above aspect of the invention is that the purged vapor mixture is maintained at a substantially constant flow rate over a range of engine operating conditions such as variations in inducted airflow. Accordingly, maximum purge of vapors is achieved even at idle conditions. Another advantage of the above aspect of the invention, is that the actual fuel vapor content of the purged vapor mixture is measured. Accordingly, highly accurate air/fuel ratio control is obtainable when Purging fuel vapors. An additional advantage is that the purged flow rate remains substantially constant regardless of variations in manifold pressure of the engine.

BRIEF DESCRIPTION OF THE DRAWINGS

The object and advantages of the invention described above and others will be more clearly understood by reading an example of an embodiment in which the invention is used to advantage, referred to herein as the Preferred Embodiment, with reference to the attached drawings wherein.

DESCRIPTION OF THE PREFERRED EMBODIMENT

Figure 1:
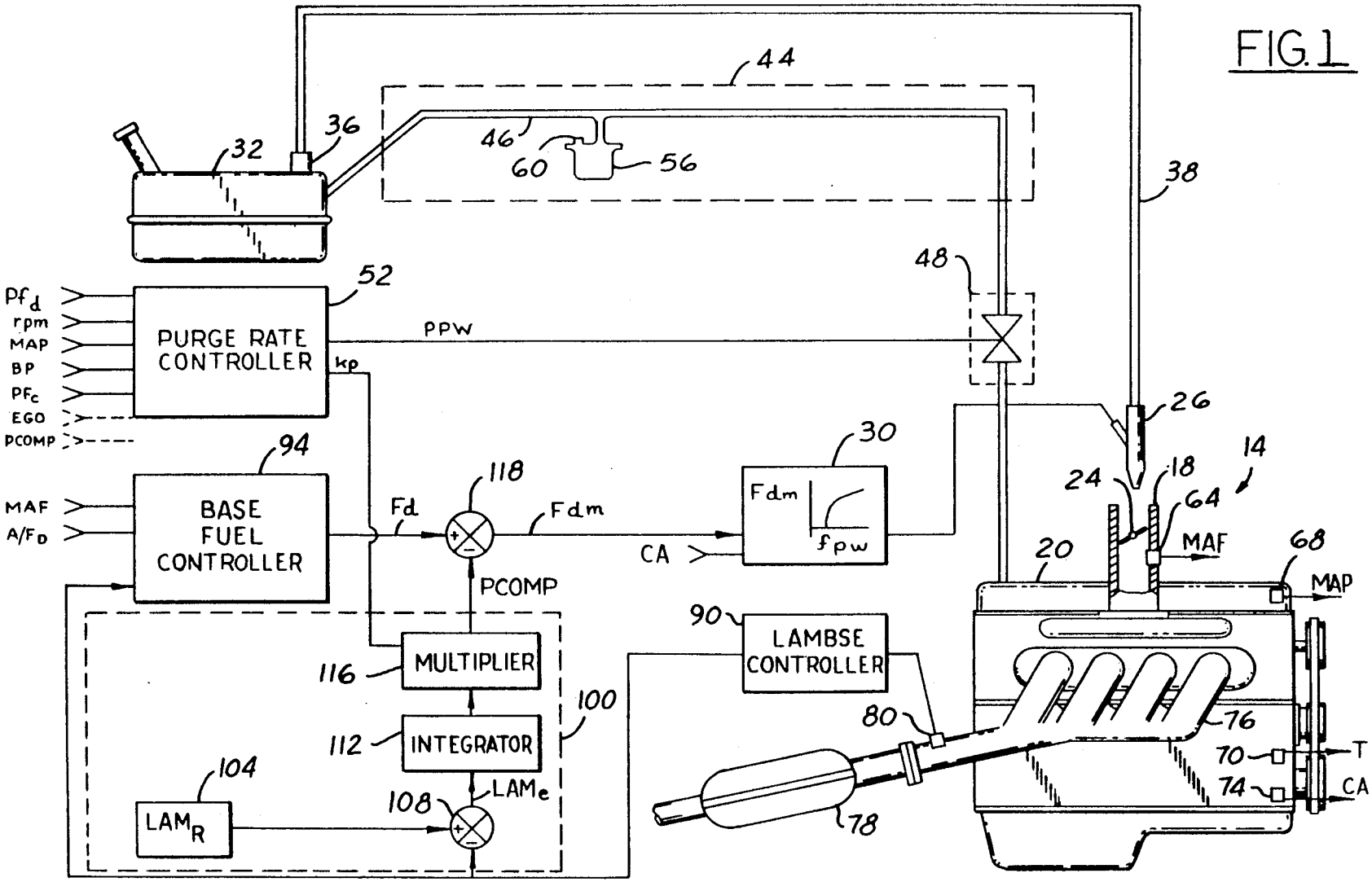
FIG. 1 is a block diagram of an embodiment wherein the invention is used to advantage.

Referring first to FIG. 1, engine 14 is shown as a central fuel injected engine having throttle body 18 coupled to intake manifold 20. Throttle body 18 is shown having throttle plate 24 positioned therein for controlling the induction of ambient air into intake manifold 20. Fuel injector 26 injects a predetermined amount of fuel into throttle body 18 in response to fuel controller 30 as described in greater detail later herein. Fuel is delivered to fuel injector 26 by a conventional fuel system including fuel tank 32, fuel pump 36, and fuel rail 38 coupled to fuel injector 26.

Fuel vapor recovery system 44 is shown coupled between fuel tank 32 and intake manifold 20 via purge line 46 and purge control valve 48. In this particular example, fuel vapor recovery system 44 includes vapor purge line 46 connected to fuel tank 32 and canister 56 which is connected in parallel to fuel tank 32 for absorbing fuel vapors therefrom by activated charcoal contained within the canister. As described in greater detail later herein, purge control valve 48 is controlled by purge rate controller 52 to maintain a substantially constant flow of vapors therethrough regardless of the rate of air inducted into throttle body 18 or the manifold pressure of intake manifold 20. In this particular example, valve 48 is a pulse width actuated solenoid valve having constant cross-sectional area. A valve having a variable orifice may also be used to advantage such as a control valve supplied by SIEMENS as part no. F3DE-9C915-AA.

During fuel vapor purge, air is drawn through canister 56 via inlet vent 60 absorbing hydrocarbons from the activated charcoal. The mixture of air and absorbed vapors is then inducted into intake manifold 20 via purge control valve 48. Concurrently, fuel vapors from fuel tank 32 are drawn into intake manifold 20 via purge control valve 48. Accordingly, a mixture of purged air and fuel vapors from both fuel tank 32 and canister 56 are purged into engine 14 by fuel vapor recovery system 44 during purge operations.

Conventional sensors are shown coupled to engine 14 for providing indications of engine operation. In this example, these sensors include mass airflow sensor 64 which provides a measurement of mass airflow (MAF) inducted into engine 14. Manifold Pressure sensor 68 provides a measurement (MAP) of absolute manifold pressure in intake manifold 20. Temperature sensor 70 provides a measurement of engine operating temperature (T). Engine speed sensor 74 provides a measurement of engine speed (rpm) and crank angle (CA).

Engine 14 also includes exhaust manifold 76 coupled to conventional 3-way ($NO_X$, CO, HC) catalytic converter 78. Exhaust gas oxygen sensor 80, a conventional two-state oxygen sensor in this example, is shown coupled to exhaust manifold 76 for providing an indication of air/fuel ratio operation of engine 14. More specifically, exhaust gas oxygen sensor 80 provides a signal having a high state when air/fuel ratio operation is at the rich side of a predetermined air/fuel ratio commonly referred to as stoichiometry (14.7 lbs. air/lb. fuel in this particular example). When engine air/fuel ratio operation is lean of stoichiometry, exhaust gas oxygen sensor 80 provides its output signal at a low state.

LAMBSE controller 90, a proportional plus integral controller in this particular example, integrates the output signal from exhaust gas oxygen sensor 80. The output control signal (LAMBSE) provided by LAMBSE controller 90 is at an average value of unity when engine 14 is operating, on average, at stoichiometry and there are no steady-state air/fuel errors or offsets. For a typical example of operation, LAMBSE ranges from 0.75–1.25.

Base fuel controller 94 provides desired fuel charge signal Fd by dividing MAF by both LAMBSE and a reference or desired air/fuel ratio ($A/F_D$) such as stoichiometry as shown by the following equation.

$$Fd = \frac{MAF}{LAMBSE * A/F_D}$$

During open loop operation, such as when engine 14 is cool and corrections from exhaust gas oxygen sensor 80 are not desired, signal LAMBSE is forced to unity.

Continuing with FIG. 1, vapor correction controller 100 provides output signal PCOMP representing a measurement of the mass flow of fuel vapors into intake manifold 20 during purge operation. More specifically, reference signal $LAM_R$, unity in this particular example, is subtracted from signal LAMBSE to generate error signal $LAM_e$. Integrator 112 integrates signal $LAM_e$ and provides an output to multiplier 116 which is multiplied by a preselected scaling factor. Vapor correction controller 100 is therefore an air/fuel ratio controller responsive to fuel vapor purging and having a controller responsive to fuel vapor purging and having a slower response time than air/fuel feedback system 28. As described in greater detail later herein, multiplier 116 also multiplies the integrated value of signal $LAM_e$ by correction factor $K_p$ from purge rate controller 52.

The resulting signal PCOMP from multiplier 116 in vapor correction controller 100 is subtracted from desired fuel signal Fd in summer 118. This modified desired fuel charge signal (Fdm) represents a correction to the desired fuel charge (Fd) generated by base fuel controller 94 for maintaining a desired air/fuel ratio ($A/F_D$) during purging operations. Fuel controller 30 converts signal Fdm into a pulse width signal (fpw) having a pulse width directly correlated with signal Fdm. Fuel injector 26 is actuated during the pulse width of signal fpw such that the desired amount of fuel is metered into engine 14 for maintaining the desired air/fuel ratio ($A/F_D$).

Those skilled in the art will recognize that the operations described for base fuel controller 94 and vapor correction controller 100 may be performed by a microcomputer in which case the functional blocks shown in FIG. 1 are representative of program steps. These operations may also be performed by discrete IC's or analog circuitry.

An example of operation of the embodiment shown in FIG. 1, and fuel vapor correction controller 100 in particular, is described with reference to operating conditions illustrated in FIGS. 2A–2H. For ease of illustration, zero propagation delay is assumed for an air/fuel charge to propagate through engine 14 to exhaust gas oxygen sensor 80. Propagation delay of course is not zero, but may be as high as several seconds. Any propagation delay would further dramatize the advantages of the invention herein over prior approaches.

Steady-state engine operation is shown before time $t_1$ wherein inducted airflow, as represented by signal MAF, is at steady-state, signal LAMBSE is at an average value of unity, purge has not yet been initiated, and the actual engine air/fuel ratio is at an average value of stoichiometry (14.7 in this particular example).

Figures 2A, 2B, 2C, 2D, 2E, 2F, 2G, 2H:
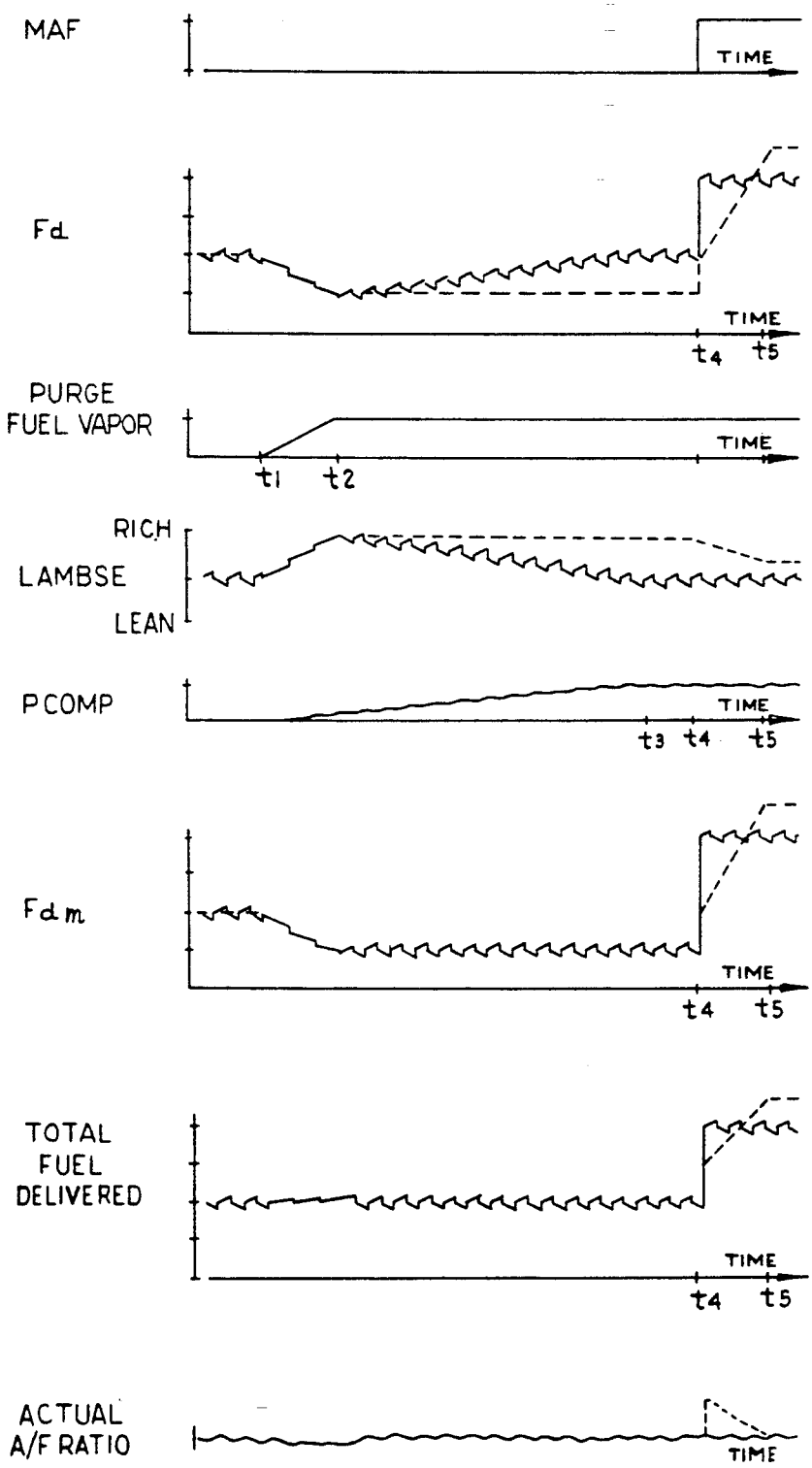
FIGS. 2A–2H illustrate various electrical waveforms associated with the block diagram shown in FIG. 1.

Referring first to FIG. 2C, vapor purge is initiated at time $t_1$. In accordance with U.S. Pat. No. 4,641,623, the specification of which is incorporated herein by reference, purge flow is gradually ramped on until it reaches the desired value at time $t_2$. For this particular example, the desired rate of purge flow is a maximum wherein the duty cycle of signal ppw is 100% . Since the inducted mixture of air, fuel, purged fuel vapor, and purged air becomes richer as the purge flow is turned on, signal LAMBSE will gradually increase as purged fuel vapors are being inducted as shown between times $t_1$ and $t_2$ in FIG. 2D. In response to this increase in signal LAMBSE, base fuel controller 94 gradually decreases desired fuel charge signal Fd as shown in FIG. 2B such that the overall actual air/fuel ratio of engine 14 remains, on average, at 14.7 (see FIG. 2H). Stated another way, fuel delivered is decreased as fuel vapor is increased to maintain the desired air/fuel ratio.

Referring to FIGS. 2D and 2E, fuel vapor controller 100 provides signal PCOMP at a gradually increasing value as signal LAMBSE deviates from its reference value of unity. More specifically, as previously discussed herein, signal PCOMP is an integral of the difference between signal LAMBSE and its reference value of unity. It is seen that as signal PCOMP increases, the liquid fuel delivered (Fdm) to engine 14 is decreased such that signal LAMBSE is forced downward until an average value of unity is achieved at time $t_3$. Signal PCOMP then reaches the value corresponding to the amount of purged fuel vapors. Accordingly, fuel vapor controller 100 adaptively learns the concentration of purged fuel vapors during a purge and compensates the overall engine air/fuel ratio for such purged fuel vapors. The operating range of authority of air/fuel feedback system 28 is therefore not reduced during fuel vapor purging. Any perturbation caused in engine air/fuel ratio by factors other than purged fuel vapors, such as perturbations in inducted airflow, are corrected by signal LAMBSE.

Referring to FIG. 2B and continuing with FIGS. 2D and 2E, it is seen that desired fuel signal Fd provided by base fuel controller 94 increases in correlation with a decrease in signal LAMBSE until, at time $t_3$, signal Fd reaches its value before introduction of purging. However, referring to FIG. 2F, modified desired fuel signal (Fdm) reaches a steady-state value at time $t_2$ by operation of signal PCOMP (i.e., Fdm=Fd−PCOMP) such that the total fuel delivered to the engine (injected fuel plus purged fuel vapors) remains substantially constant before and during purging operation as shown in FIG. 2G. Accordingly, fuel vapor correction controller 100 will generate signal PCOMP which is essentially a measurement of the amount of fuel vapors during purging operations. And base fuel controller 94 will generate a desired fuel charge signal (Fd) representative of fuel required to maintain the desired engine air/fuel ratio independently of purging operations.

The illustrative example continues under conditions where the engine throttle, and accordingly inducted airflow (MAF), are suddenly changed as shown at time $t_4$ in FIG. 2A. Since the rate of purge flow is maintained relatively constant by operation of purge rate controller 52, as described in greater detail later herein, signal PCOMP remains at a substantially constant value despite the sudden change in inducted airflow (see FIG. 2E). Correction for the lean offset provided by the sudden increase in inducted airflow will then be provided by base fuel controller 94 (as described previously herein and as further illustrated in FIGS. 2B, 2F, and 2G, and 2H). On the other hand, without operation of fuel vapor controller 100, a transient in engine air/fuel ratio would result with any sudden increase in throttle angle. This, as previously discussed, is indicative of prior feedback approaches.

To illustrate the above problem, dashed lines are presented in FIGS. 2B, 2D, 2F, 2G, and 2H which are illustrative of operation without fuel vapor correction controller 100 and its output signal PCOMP. It is seen that the sudden change in airflow at time $t_4$ causes a lean perturbation in air/fuel ratio until signal LAMBSE provides a correction at time $t_5$. This perturbation occurs because base fuel controller 94 initially offsets desired fuel charge Fd in response to signal MAF (i.e., Fd=MAF/14.7/LAMBSE). The overall air/fuel mixture is now leaner than before time $t_4$ because purge vapor flow has not increased in proportion to the increase in inducted airflow. LAMBSE controller 90 will detect this lean offset during the time interval from $t_4$ through $t_5$ and base fuel controller 94 will appropriately adjust the fuel delivered by time $t_5$. However, an air/fuel transient occurs between times $t_4$ and $t_5$ as shown in FIG. 2H.

The air/fuel transient described above, however, does not occur in the Preferred Embodiment because fuel vapor correction controller 100 provides an immediate correction for the purged fuel vapors regardless of changes in inducted airflow.

Operation of purge rate controller 52 and purge valve 48 are now described in more detail with reference to FIG. 3 and FIGS. 4A–4C. As previously discussed herein, control valve 48 is a solenoid actuated valve having constant cross-sectional valve area. Vapor flow therethrough is therefore related to the on time during which the solenoid is actuated. Stated another way, vapor flow is related to the pulse width and duty cycle of signal ppw from purge rate controller 52. For example, at 100% duty cycle, vapor flow is at the maximum enabled by the cross-sectional valve area. Whereas, at 50% duty cycle, vapor flow is one-half of maximum assuming that vapor flow is linear to duty cycle under all operating conditions. This assumption of linearity is accurate when absolute manifold pressure (MAP) of intake manifold 20 is sufficiently low, or manifold vacuum is sufficiently high, for the vapor flow through purge valve 48 to be sonic. Otherwise, flow through purge valve 48 is both a function of MAP and the duty cycle of signal ppw.

Figure 3:
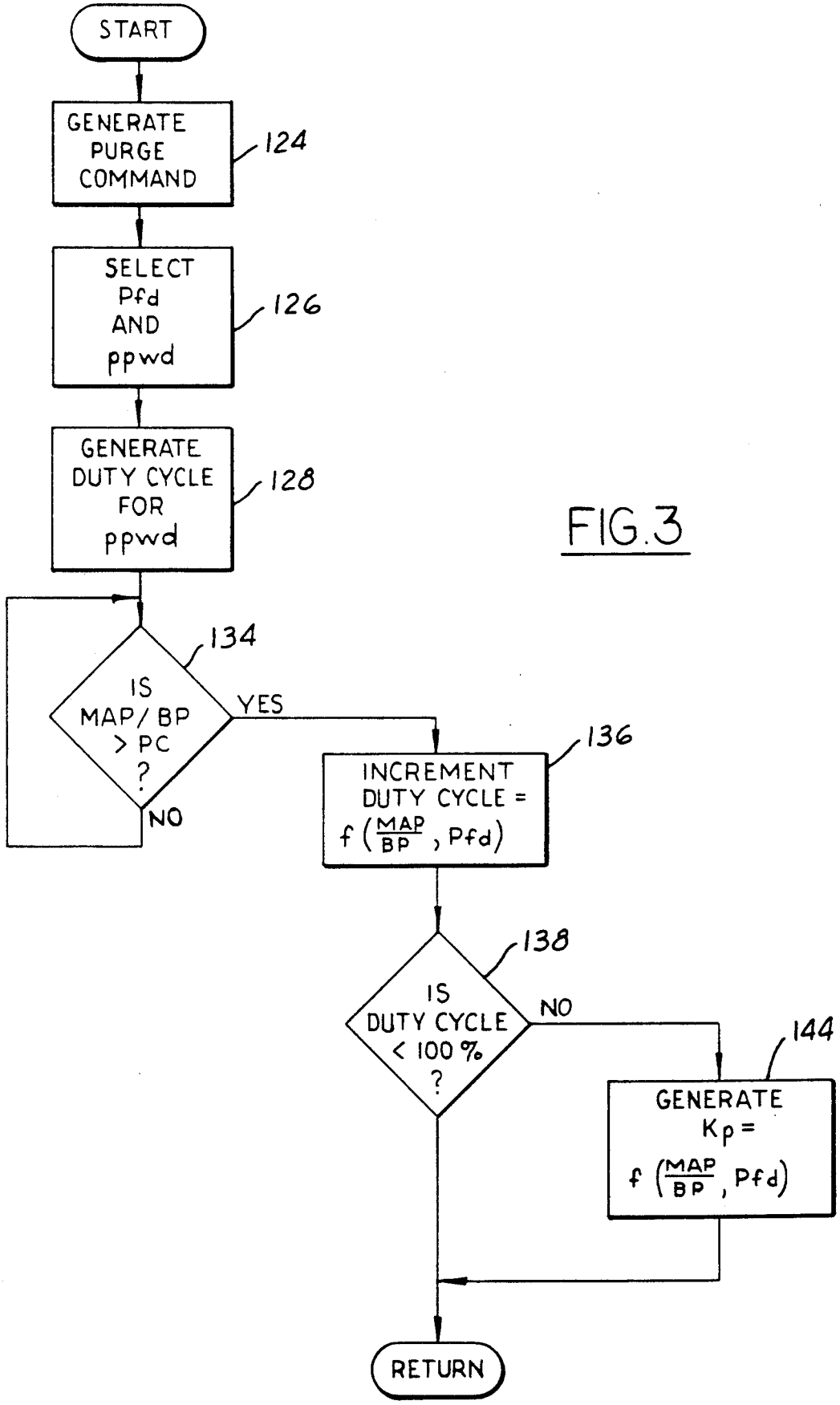
FIG. 3 is a high level flowchart illustrating various decision making steps performed by a portion of the components illustrated in FIG. 1.

In general, purge rate controller 52 increases the duty cycle of signal ppw to compensate for any subsonic flow conditions caused by an increase in MAP to maintain a linear relationship between the duty cycle of signal ppw and vapor flow through purge valve 48. Referring specifically to FIG. 3, a high level flowchart of a series of steps performed by a microcomputer are illustrated for embodiments in which the operation of purge rate controller 52 is performed by a microcomputer or equivalent device. Those skilled in the art will recognize that the operation of purge rate controller 52 described herein may also be performed by other conventional components such as discrete IC's or analog circuitry.

Referring to the process steps shown in FIG. 3, a purge command is provided during step 124 in response to engine operating conditions such as engine temperature (T), and engine speed (rpm). In response, a desired purge flow (Pfd), and the corresponding duty cycle for signal ppw (ppwd), are selected during steps 126 and 128 assuming a linear relationship.

During step 134, a determination of whether purge valve 48 is operating under sonic or subsonic conditions is made. In this particular example, absolute manifold pressure is normalized to ambient barometric pressure (MAP/BP) and this ratio compared to a critical value (Pc) associated with the transition from sonic to subsonic flow for the particular valve utilized. If the ratio MAP/BP is greater than critical value Pc, then the duty cycle of signal ppw is incremented by a predetermined amount during step 136 as determined by a look up table of ppw versus MAP/BP for desired purge flow Pfd (see FIG. 4B). In effect, the on time of purge valve 48 is being increased to compensate for the nonlinear relationship between flow and duty cycle during subsonic operation of purge valve 48.

When 100% duty cycle is achieved, compensation for subsonic flow by duty cycle increase is no longer possible. If not corrected for, such conditions would result in a perturbation in air/fuel operation of engine 14. This condition is corrected by generating multiplier factor $K_p$ as a function of MAP/BP and Pfd during step 144 (see also FIG. 4C). Multiplier factor $K_p$ multiplies the output of integrator 12 (see FIG. 1) such that signal PCOMP is appropriately reduced, thereby averting a transient in the engine's air/fuel ratio. Stated another way, the fuel correction factor (PCOMP) which corrects the engine air/fuel ratio for a constant vapor flow is appropriately reduced when the vapor flow rate falls below the desired flow rate (Pfd) as a result of subsonic flow conditions through purge valve 48.

Figure 4A:
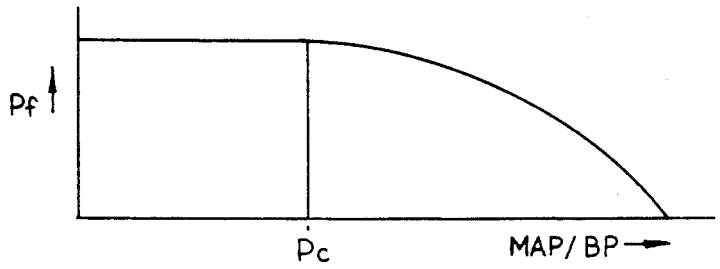
FIGS. 4A–4D are a graphical representation in accordance with the illustration shown in FIG. 3.
Figure 4B:
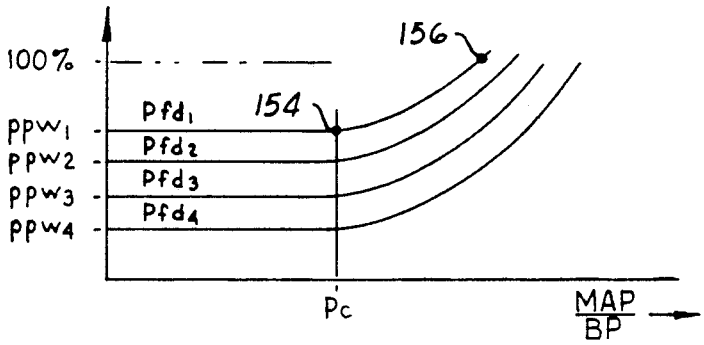

The operation of purge rate controller 52 may be better understood by viewing an example of operation presented in FIGS. 4A–4D. FIG. 4A represents purge flow as a function of the MAP/BP ratio for constant duty cycle of signal ppw. It is seen that when the ratio MAP/BP is below critical value Pc, flow through valve 48 is sonic such that there is no variation in Pfd. As the ratio MAP/BP exceeds critical value Pc, the flow through purge valve 48 becomes subsonic and Pfd can no longer be held at a constant value by a constant duty cycle of signal ppw. To compensate for degradation in purge flow caused by subsonic flow conditions, signal ppw is increased in accordance with a look up table as represented by FIG. 4B.

Figure 4C:
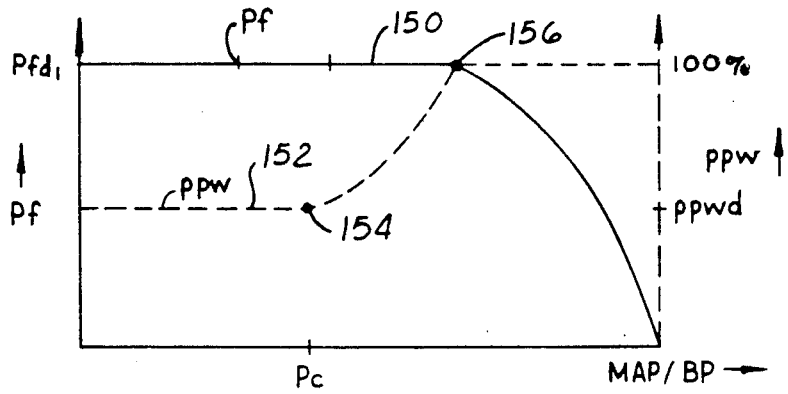
Figure 4D:
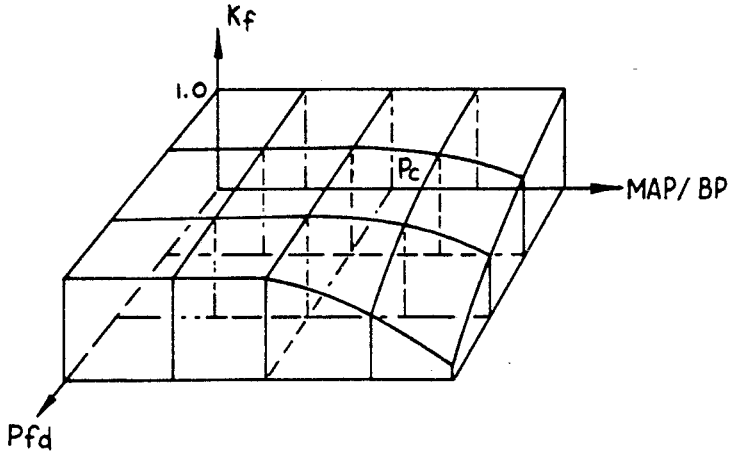

Referring to both FIGS. 4B and 4C, compensation for subsonic flow conditions is shown for a particular desired purge flow ($Pfd_1$) wherein solid line 150 represents rate of purge flow (Pf) and dashed line 152 represents signal ppw. When the MAP/BP ratio exceeds Pc, signal ppw is increased in accordance with the look up function shown in FIG. 4B such that $Pfd_1$ remains substantially constant as shown between point 154 and point 156 in FIG. 4C. When the MAP/BP ratio exceeds that associated with point 156 (duty cycle of signal ppw is at 100%), then compensation for subsonic flow conditions proceeds by generating compensation factor $K_p$. Compensating factor $K_p$ is generated by a look up table of the MAP/BP ratio versus desired purge flow as shown in FIG. 4D and previously discussed herein.

This concludes the description of the Preferred Embodiment. The reading of it by those skilled in the art will bring to mind many modifications and alterations without departing from the spirit of the invention. Accordingly, it is intended that the invention be limited only by the following claims.

What is claimed:

1. A control system for a vehicle having a fuel vapor recovery system coupled between an engine air/fuel intake and a fuel supply system, comprising:

feedback control means responsive to an exhaust gas oxygen sensor for providing an air/fuel ratio indication of the engine operation;

command means for providing a base fuel command in response to said air/fuel ratio indication;

purging means coupled to the fuel supply and the fuel vapor recovery system for purging a vapor mixture of fuel vapor and air into the engine air/fuel intake;

fuel vapor measurement means for providing a measurement of fuel vapor content in said purged vapor mixture by subtracting a reference air/fuel ratio, related to engine operation without purging, from said air/fuel ratio indication to generate an air/fuel ratio error; and compensating means for subtracting said fuel vapor content measurement from said base fuel command to operate the engine at a desired air/fuel ratio during fuel vapor purging.

2. The control system recited in claim 1 wherein said purging means includes an electronically controllable valve.

3. The control system recited in claim 2 further comprising valve control means coupled to said valve for purging said purge vapor mixture at a substantially constant rate over a range of engine operating conditions.

4. A control system for a vehicle having a fuel vapor recovery system coupled between an engine air/fuel intake and a fuel supply system, comprising:

feedback control means responsive to an exhaust gas oxygen sensor for providing an air/fuel ratio indication of engine operation;

command means for providing a base fuel command to a fuel delivery system in response to both said air/fuel ratio indication and a measurement of ambient air inducted through a throttle body into the engine;

purging means coupled to the fuel supply and the fuel vapor recovery system for periodically purging a vapor mixture of fuel vapor and air into the engine air/fuel intake, said purging means including an electronically controllable valve;

valve control means coupled to said valve for purging said purged vapor mixture at a substantially constant rate independently of flow rate of said inducted ambient air;

fuel vapor measurement means for providing a measurement of fuel vapor content in said purged vapor mixture by subtracting a reference air/fuel ratio, related to engine operation without purging, from said air/fuel ratio indication to generate an air/fuel ratio error and integrating said air/fuel ratio error; and compensating means for subtracting said fuel vapor content measurement from said base fuel command to operate the engine at a desired air/fuel ratio during fuel vapor purging.

5. The control system recited in claim 4 wherein said feedback control means comprises a proportional plus integral controller.

6. The control system recited in claim 4 wherein said valve comprises a solenoid actuated valve.

7. A control system for a vehicle having a fuel vapor recovery system coupled between a fuel supply system and an intake manifold of an internal combustion engine, comprising:

feedback control means responsive to an exhaust gas oxygen sensor for providing an air/fuel ratio indication;

command means for providing a base fuel command in response to said air/fuel ratio indication;

purging means responsive to engine operating parameters for purging fuel vapors from the fuel vapor recovery system into the intake manifold at a substantially constant flow rate by controlling a valve positioned between the fuel vapor recovery system and the intake manifold, said purging means including regulation means for further controlling said valve in relation to pressure at said intake manifold to maintain said constant flow rate;

vapor indicating means for providing an indication of vapor content in said purged fuel vapors by subtracting a reference air/fuel ratio, related to engine operation without purging, from said air/fuel ratio indication to generate an air/fuel ratio error and integrating said air/fuel ratio error indication; and compensation means for subtracting a purged vapor compensation factor related to said vapor content indication from said base fuel command for operating said engine at a desired air/fuel ratio during fuel vapor purging.

8. The control system recited in claim 7 wherein said valve comprises a solenoid actuated valve and said regulation means increases on time of actuating said valve in relation to pressure at said intake manifold.

9. The control system recited in claim 7 wherein said command means is further responsive to a measurement of airflow inducted into the intake manifold.

10. A control system for a vehicle having a fuel vapor recovery system coupled between a fuel supply system and an intake manifold of an internal combustion engine, comprising:

feedback control means responsive to an exhaust gas oxygen sensor for providing an air/fuel ratio indication;

command means for providing a base fuel command in response to said air/fuel ratio indication;

purging means responsive to engine operating parameters for purging fuel vapors from the fuel vapor recovery system into the intake manifold at a substantially constant flow rate;

vapor indicating means for providing an indication of vapor content in said purged fuel vapors by subtracting a reference air/fuel ratio, related to engine operation without purging, from said air/fuel ratio indication to generate an air/fuel ratio error and integrating said air/fuel ratio error indication; and compensation means for subtracting a purged vapor compensation factor related to said vapor content indication from said base fuel command for operating said engine at a desired air/fuel ratio during fuel vapor purging, said compensation means including adjustment means for reducing said vapor compensation factor when a pressure drop across the intake manifold falls below a predetermined value.

11. The control system recited in claim 10 wherein said adjustment means comprises a look up table of pressure in said intake manifold versus purge flow rate.

12. A method for controlling operation of an engine wherein a fuel vapor recovery system is coupled between an air/fuel intake and a fuel supply system, comprising the steps of:

providing an air/fuel ratio indication of the engine operation in response to an exhaust gas oxygen sensor;

generating a base fuel command in response to said air/fuel ratio indication;

purging a vapor mixture of fuel vapor and air from the fuel vapor recovery system into the engine air/fuel intake through an electronically controllable valve;

controlling said valve to purge said purged vapor mixture at a substantially constant rate over a range of engine operating conditions;

measuring fuel vapor content in said purged vapor mixture by subtracting a reference air/fuel ratio, related to engine operation without purging, from said air/fuel ratio indication to generate an air/fuel ratio error; and subtracting said fuel vapor content measurement from said base fuel command to operate the engine at a desired air/fuel ratio during fuel vapor purging.

13. A method for controlling operation of an engine wherein a fuel vapor recovery system is coupled between an air/fuel intake and a fuel supply system, comprising the steps of:

providing an air/fuel ratio indication of the engine operation in response to an exhaust gas oxygen sensor;

generating a base fuel command for a fuel delivery system in response to both said air/fuel ratio indication and a measurement of ambient air inducted through a throttle body into the engine;

periodically purging a vapor mixture of fuel vapor and air from the fuel vapor recovery system into the engine air/fuel intake through an electronically controllable valve;

purging said purged vapor mixture at a substantially constant rate independently of flow rate of said inducted ambient air;

measuring fuel vapor content in said purged vapor mixture by subtracting a reference air/fuel ratio, related to engine operation without purging, from said air/fuel ratio indication to generate an air/fuel ratio error and integrating said air/fuel ratio error; and subtracting said fuel vapor content measurement from said base fuel command to operate the engine at a desired air/fuel ratio during fuel vapor purging.

* * * * *